United States Patent [19]

Chatani

[11] 4,305,221

[45] Dec. 15, 1981

[54] BLOCK OF MEMBERS HAVING INTERIOR INTERLOCK MEANS

[75] Inventor: Yasushi Chatani, Tokorozawa, Japan

[73] Assignee: Kawada Co., Ltd., Tokyo, Japan

[21] Appl. No.: 64,522

[22] Filed: Aug. 7, 1979

[30] Foreign Application Priority Data

Sep. 3, 1979 [JP] Japan ..... 54-29213[U]

[51] Int. Cl.[3] ..... A63H 33/10

[52] U.S. Cl. ..... 46/25

[58] Field of Search ..... 46/25, 26, 28, 29, 30, 46/31, 23, 16, 17; 35/18 A

[56] References Cited

U.S. PATENT DOCUMENTS

| | | | |
|---|---|---|---|
| 3,412,502 | 11/1968 | Riches | 46/25 |
| 3,604,130 | 9/1971 | Forsstrom | 46/25 X |
| 3,611,621 | 10/1971 | Folson | 46/25 |
| 4,103,774 | 8/1978 | Shingyouchi | 46/25 X |

*Primary Examiner*—F. Barry Shay

*Attorney, Agent, or Firm*—Don B. Finkelstein

[57] ABSTRACT

An improved, frictional, interconnecting toy block arrangement having a body means with walls defining a body cavity. The body means of the block is fabricated of two separate body members coupled together along a median plane. Coupling means are provided on the two body members to retain the two body members together. Each of the two body members may be provided with a different appearance, such as, for example, different color, different surface texture, or the like. A female interblock coupling means is provided as an integral part of each of the two body members and the female interblock coupling means comprises a skirt member extending into the body cavity and defining the male interblock coupler means receiving aperture. For the two body members of the body means coupled together the apertures in each are aligned and the inner ends of each of the skirt members within the body cavity are provided with interconnection structure for coupling the inner ends of the skirt members together. One or more toy blocks of a set of toy blocks, are also provided with a male interblock coupler means extending outwardly from one of the walls of the body means and the male interblock coupler means is configured to be frictionally and detachably interconnectable into the female interblock coupling means on another block. The male interblock coupler means are generally fabricated as part of the body means of the block.

19 Claims, 12 Drawing Figures

FIG. 3
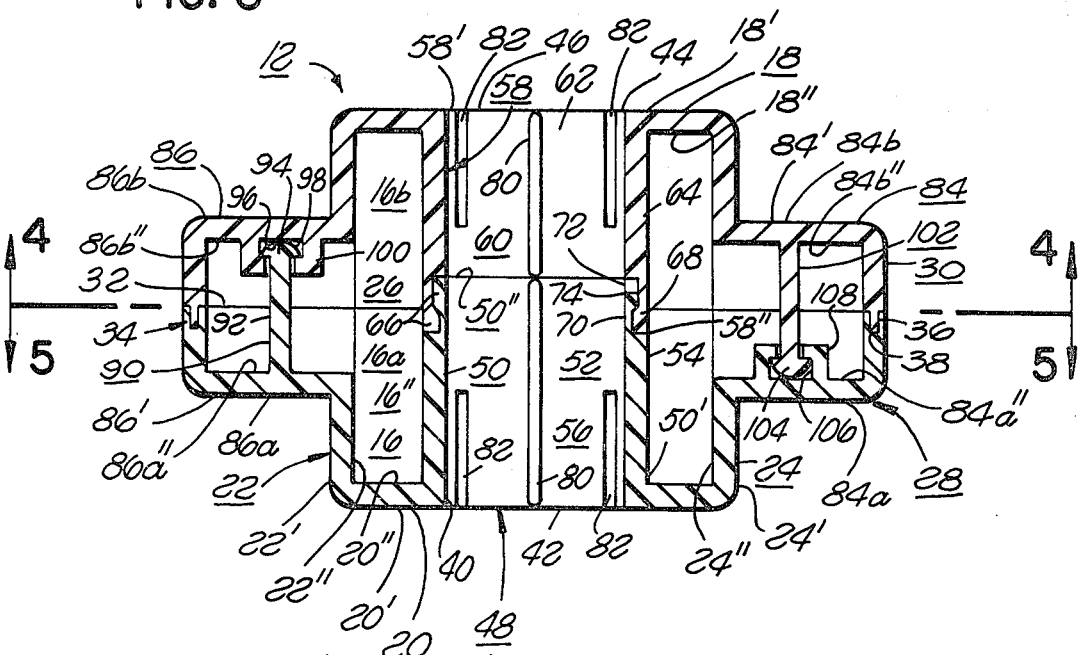
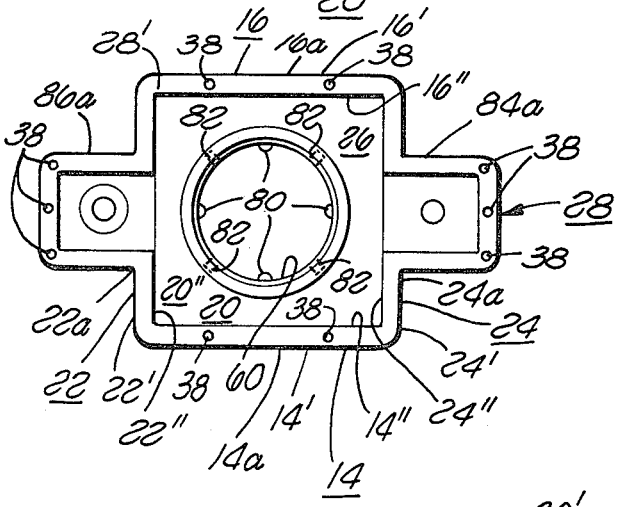
FIG. 4
FIG. 5
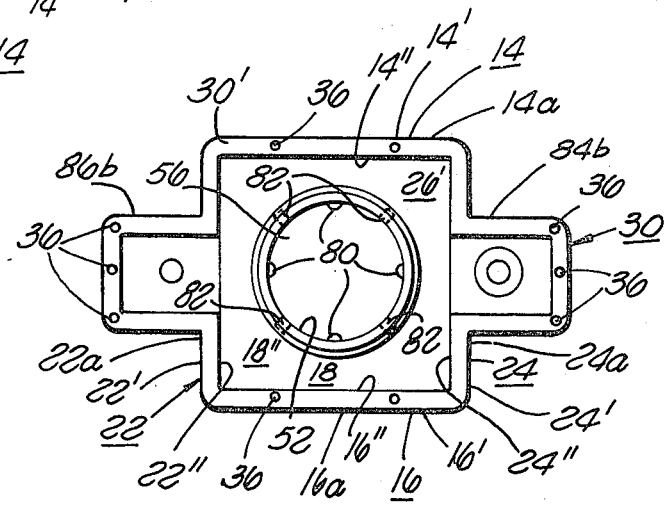

BLOCK OF MEMBERS HAVING INTERIOR INTERLOCK MEANS

BACKGROUND OF THE INVENTION

1. Field of the Invention

This invention relates to toy blocks, and, more particularly, to hollow toy blocks having frictional interconnection arrangements for detachable interconnection of a plurality of individual toy blocks.

2. Description of the Prior Art

Toy blocks have long been fabricated from many different materials. Wood, ceramics, metals, and plastics have all been utilized heretofore. Various different interlocking or interconnecting arrangements have also been utilized to permit the blocks to be interconnected with each other and removed from each other. Such interconnection arrangements have heretofore included tongue-in-groove interconnections, notches and matching male members of various types, pin and slot arrangements, and various kinds and shapes of protrusions and protrusion accepting apertures.

Toy blocks, in general, are designed for children, to entertain, educate and aid in the development of improved physical dexterity. Many of the above different interconnection combinations are specifically designed to appeal to children having particular age and mental development levels. That is, difficult interconnection combinations generally appeal to older and more educationally developed children, and/or to children having a comparatively high degree of physical dexterity. However, simpler interconnecting arrangements are required for younger children, since, in the case of younger children, it is very important to provide toys which challenge the child, but do not frustrate the child to the point that the child rejects the toys. The small fingers, lack of physical strength, and limited manual dexterity of younger children impose constraints on the design and fabrication of interconnecting toy blocks. Such toy blocks, for such younger children, must, therefore, be comparatively easy to connect together and disconnect. Such ease of interconnection and removal enhances the play value of the blocks. Further, it is also required that such blocks, when interconnected, are able to withstand the rigors and stresses normally associated with the use of the blocks without inadvertent disconnection.

Additionally, the blocks should also be able to provide a level of complexity and sophistication during play, sufficient to maintain the interest of older children or even adults, in order to extend the play life and utility thereof. Such blocks should also be visually attractive in order to further enhance their play value. The above, often conflicting, requirements, have not, heretofore, been achieved in interconnecting toy block arrangements.

Particularly, in molded plastic toy blocks, the body means of the toy blocks has heretofore been generally unitarily fabricated. As such, the entire body means of the toy blocks was fabricated of the same material, having the same surface texture, and the same molded in color. It has been found that enhanced play value can be achieved by providing the body means of the toy blocks having different colors on different portions thereof. This tends to increase the attractiveness of blocks as a playtime object and, further, provides for a greater variety of visual appearances in the structures created by the interconnection of a plurality of such blocks. In order to achieve such difference in color in a single toy block of an interconnecting toy block arrangement, it has heretofore been necessary to attempt to provide different colors on different portions by use of paint or other surface colorations. Such steps are, of course, comparatively expensive. Preferably, a plurality of colors is provided in the fabrication of the toy block itself, so the extra step of applying the surface coloration becomes unnecessary.

SUMMARY OF THE INVENTION

Accordingly, it is an object of the present invention to provide an improved interconnecting toy block arrangement.

It is another object of the present invention to provide a comparatively inexpensively fabricated toy block arrangement.

It is another object of the present invention to provide interconnecting toy blocks wherein each of the toy blocks has a body means fabricated of two separate body members, each of which may be differently colored.

It is another object of the present invention to provide interconnecting toy blocks which may be comparatively easily connected together and disconnected by the small fingers of young children and yet resistant to inadvertent disconnection.

It is another object of the present invention to provide an interconnecting toy block arrangement which, through its utilization, improve the manual dexterity of the user.

It is yet another object of the present invention to provide an improved toy block arrangement which is visually attractive and still provides a high level of play value and is comparatively inexpensive to fabricate.

The above, and other objects of the present invention are realized in a preferred embodiment, by providing a semi-rigid body means having a plurality of wall members, and each of the wall members having inner surfaces and outer surfaces. The inner surfaces of the plurality of wall members define a body cavity. The body means is further comprised of a first body member which is comprised of a first group of the plurality of wall members, and a second body member which is comprised of a second group of the plurality of wall members. Coupling means are provided on the first body member and second body member, for coupling the first body member to the second body member along a median plane. The first body member and second body member may, for example, be injection molded plastic and, during the injection molding fabrication thereof, may have coloration provided so that the first body member has a different color than the second body member. Alternatively, or in addition, a surface texture or other characteristic of the first body member may vary from that corresponding characteristic of the second body member.

The first wall of one of the plurality of wall members of the first body member, has walls defining a first aperture therethrough and a second wall of one of the wall members of the second body member of the body means has walls defining a second aperture therethrough which is aligned with the first aperture. Female interblock coupling means are provided and generally comprise a skirt member on the first wall of the first body means at the first aperture and extending into the body cavity. A second skirt member is provided on the second wall of the second body member at the second aperture and also extends into the body cavity and both the first skirt member and the second skirt member have inner ends in regions adjacent the median plane. The inner ends of the first skirt member and second skirt member are coupled together. The first skirt member and second skirt member define a male interblock coupler means receiving aperture adapted to receive a male interblock coupler means of another toy block, according to the principles of the present invention for frictional and detachable retention therein. Preferably, the first skirt member and second skirt member are molded integrally with the first body member and second body member, respectively, and their inner ends are joined together when the first body member is coupled to the second body member.

One or more toy blocks of a set of toy blocks in accordance with the principles of the present invention, are provided with a male interblock coupler means extending outwardly from a wall member of the body means. The male coupler means, in preferred embodiments of the present invention, is divided along the median plane and, preferably, is also molded integrally with the first body member and second body member. The male coupler means are sized and configured to fit within the aperture of the female coupler means, and, as noted above, to be frictionally and detachably retained therein.

In preferred embodiments of the present invention, the skirt members defining the male coupler means receiving aperture is provided with a plurality of ribs so that the ribs contact the male coupler means when two blocks are interconnected to provide the frictional and detachable interconnection. In such embodiments, since only the ribs rather than the entire skirt contact the male coupler means, the friction, and therefore the force and dexterity required to interconnect and disassemble the toy blocks, one from the other, is reduced without reducing the play value or interest thereof. Further, if desired, slots may be provided in the skirt members in regions adjacent their outer ends at the wall members of the body means to allow a resilient expansion thereof when the male coupler means is inserted in the aperture of the female coupler means. Such slots further provide more precise control of the frictional force retaining the blocks in interconnected condition.

BRIEF DESCRIPTION OF THE DRAWING

The above and other objects of the present invention may be more fully understood from the following detailed description taken together with the accompanying drawing, wherein similar reference characters refer to similar elements throughout, and in which:

FIG. 3 is a sectional view, taken along the line 3—3 of FIG. 2;

FIG. 4 is a view of one of the body members of the embodiment shown in FIG. 3, taken generally along the view line 4—4 of FIG. 3;

FIG. 5 is a view of the other body member of the embodiment shown in FIG. 3, taken generally along the view line 5—5 of FIG. 3;

DESCRIPTION OF PREFERRED EMBODIMENTS

Figure 1:
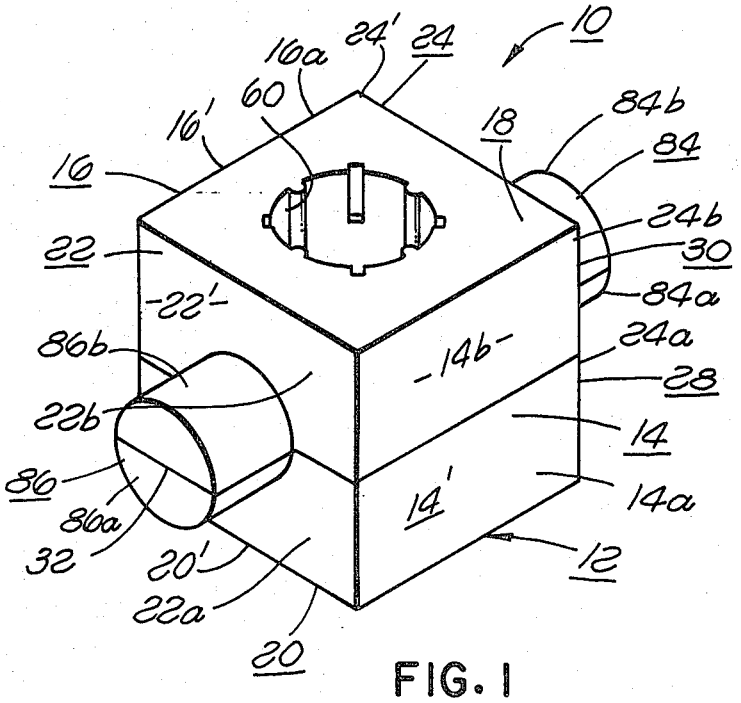
FIG. 1 is a perspective view of one embodiment of the present invention.

Referring now to FIGS. 1, 2, 3, 4 and 5, there is illustrated one embodiment generally designated 10, of an interconnecting toy block arrangement according to the principles of the present invention. In the embodiment 10, there is provided a semi-rigid body means generally designated 12, having a first predetermined flexibility and having a plurality of wall members 14, 16, 18, 20, 22 and 24. In the embodiment 10, the plurality of wall members 14, 16, 18, 20, 22 and 24 define substantially a cube. However, it will be appreciated that applicant's invention is not limited to blocks in which the body members form a cube. Rather, applicant's invention as hereinafter described may be utilized with blocks having wall members defining different configurations such as a rectangular parallelepiped, or otherwise. Thus, the particular configuration of the body means 12, illustrated in FIGS. 1, 2, 3, 4, and 5 is for illustrative purposes only.

Each of the plurality of wall members 14, 16, 18, 20, 22, and 24, have corresponding external surfaces 14', 16', 18', 20', 22', and 24', and corresponding internal surfaces 14'', 16'', 18'', 20'', 22'', and 24'', and the internal surfaces define the body cavity generally designated 26.

The semi-rigid body means 12 is preferably fabricated from an injection molded plastic such as, for example, ABS, or the like, and has a predetermined flexibility. The body means 12 is fabricated of a first body member 28 and a second body member 30. The first body member 28 and second body member 30 are coupled together along a median plane generally designated 32. Thus, the median plane 32 divides each of the wall members, 14, 16, 18, 20, 22 and 24, into two groups. Body member **28*a* thus has a first group of the plurality of wall members indicated at 14*a*, 16*a*, 22*a*, 24*a* and 20. Second body member 30 is thus comprised of a second group of the plurality of wall members indicated at 14*b*, 16*b*, 22*b*, 24*b* and 18. The first body member 28 is coupled to second body member 30 along the median plane 32, and first body member 28 has peripheral edge surfaces 28' and second body member 30 has peripheral edge surfaces 30' along the median plane and first body member 28 is coupled to second body member 30 on the peripheral edges 28' and 30', respectively. In order to provide this coupling, a coupling means, generally designated 34 is provided on the first body member 28 and second body member 30 to couple the first body member 28 to the second body member 30 along the median plane 32. The coupling means 34 generally comprises a plurality of male coupling members 36 on peripheral edge 30' of second body member 30 and extending outwardly therefrom. In the embodiment 10, the male coupling members 36 are generally cylindrical. The first body member 28 is provided with a plurality of male body coupling member receiving cavities 38** in peripheral edge 28', aligned to receive the plurality of male body coupling members 36. In embodiment 10, the male body coupling members 36 are frictionally retained in the male body coupling member receiving cavities 38 to retain first body member 28 coupled with second body member 30. In preferred embodiments of the present invention, the first body member 28, and the second body member 30 are adapted to be coupled together by the above mentioned frictional engagement during the normal play activities. However, it will be appreciated that in other embodiments of the present invention, the first body member 28 may be selectively removed from the second body member 30 in order that they may be combined with corresponding second body member and first body member of other such disassembled blocks.

In order to increase the play value of the blocks, according to the principles of the present invention, first body member 28 is preferably colored a different color from the second body member 30. Thus, when the blocks are fabricated as mentioned above from injection molded plastic, such coloring may be applied during the molding process and thus there is provided a body means 12 in which half of the body means, such as first body member 28 is of one color and second body member 30 is of a different color. Additionally, or alternatively, it will be appreciated that different surface textures may be provided on the two body members 28 and 30 in order to further increase their attractiveness and enhance their play value. As noted above, in prior art blocks, such as plastic blocks, different colors on any one block could generally only be provided by surface coating, such as by painting or the like, which is comparatively time consuming and expensive and thus the blocks, according to the principles of the present invention, may be much more economically fabricated in a more attractive manner than blocks heretofore available.

In the embodiment 10, the male coupling members 36 are shown on body member 30 and the male body coupling member receiving cavities are shown on body member 28. It will be appreciated that in other embodiments of the present invention, male body coupling members may be provided on both body members with appropriately aligned male body member coupling receiving cavities on the other body member.

Wall 20 of first body member 28 of body means 12 is provided with first internal walls 40 defining a first aperture 42 therethrough. Wall 18 of second body member 30 of body means 12 has second walls 44 defining a second aperture 46 therethrough. First aperture 42 and second aperture 46 are aligned when first body member 28 and second body member 30 are coupled together as illustrated in FIG. 3. Female interblock coupling means, generally designated 48, are provided on wall member 20 and wall member 18 of body means 12. The female interblock coupling means 48 is comprised of a first skirt member 50, coupled to the inner surface 20" of wall member 20 at the first walls 40, and extend into the body cavity 26. First skirt member 50 is coupled at its outer end 50' to wall member 20, and, in preferred embodiments of the present invention, as illustrated in FIG. 3, is molded integrally with first body member 28. First skirt member 50 has an inner end 50" in the body cavity 26 and first skirt member 50 has inner wall surfaces 52 and outer wall surfaces 54 extending between outer end 50' and inner end 50". The inner wall surfaces 52, of first skirt member 50, define a male coupler means receiving aperture 56.

Female interblock coupling means 48 also comprises a second skirt member 58 coupled to the inner surface 18" at the second aperture 46 and extends into the body cavity 26 of body means 12. second skirt member 58 has an outer end 58' coupled to internal walls 18" of second body member 30 and an inner end 58" in body cavity 26. Second skirt member 58 has inner wall surfaces 60 defining a male interblock coupler means receiving aperture 62, and outer wall surfaces 64.

As shown in FIG. 3, in embodiment 10, the inner ends 50" of first skirt member 50 and 58" of second skirt member 58, extend beyond the median plane 32 and are further provided with interlock means generally designated 66, which function as part of the coupling means for retaining the first body member 28 coupled with the second body member 30 and interlock the first skirt member 50 to the second skirt member 58. As illustrated in FIG. 3, the interlock means comprises a shoulder 68 on inner surface 60 of second skirt member 58 which fits into a peripheral groove 70 on the outer surface 54 of first skirt member 50. Similarly, a second peripheral shoulder 72 is provided on the outer surface 54 of first skirt member 50 which fits into a peripheral groove 74 on the inner surface 60 of second skirt member 58.

Thus, not only does the interlock means 66 provide additional coupling between the first body member 28 and second body member 30, but also provides additional stiffness and rigidity to the body means 12 between the walls 18 and 20. Such stiffness is preferred, since, as described below, it is into the apertures 56 and 62 that the male coupler means are inserted during the interconnection of blocks.

In some embodiments of the present invention, it may be desirable to provide a plurality of internal ridges 80 on the internal surfaces 52 and 60 of first skirt member 50 and second skirt member 58, respectively, for purposes hereinafter set forth. Additionally, in some embodiments of the present invention, there may also be provided a plurality of slots 82 in either or both the wall members 18 and 20 adjacent the internal walls 44 and 40, respectively, and/or extending into the second skirt member 58 and first skirt member 50, respectively, as shown in FIG. 3. The purpose of the slots 82 is discussed below.

Preferably, the slots 82, in those embodiments wherein they are provided in the skirt members, do not extend from the outer ends all the way through to the inner ends thereof.

The wall member 24 of body means 12 is provided, in the embodiment 10, with the first male interblock coupler means 84, which extends outwardly therefrom a predetermined distance. Preferably, the predetermined distance is less than the distance from the outer surface 20' of wall 20 to the median plane 32. The first male interblock coupler means 100 is configured to match the apertures such as apertures 56 and 62 of first skirt member 50 and second skirt member 58, respectively, as defined by their respective internal walls 52 and 60. This provides a frictional and detachable retention of the male interblock coupler means 100 in the female interblock coupler means 48, so that blocks according to the principles of the present invention may be frictionally detachably interconnected with each other and then removed. In the particular block embodiment 10, there is also provided a second male interblock coupler means 86, extending outwardly a predetermined distance from the wall 22. Second male interblock coupler means 86 is substantially identical to first male interblock coupler means 84. In embodiment 10, it can be seen that both first male interblock coupler means 84 and second male interblock coupler means 86 are divided by the median plane 32 into a first portion 84*a* of first body member 28 and 84*b* of second body member 30 and 86*a* of first body member 28 and 86*b* of second body member 30.

Figure 2:
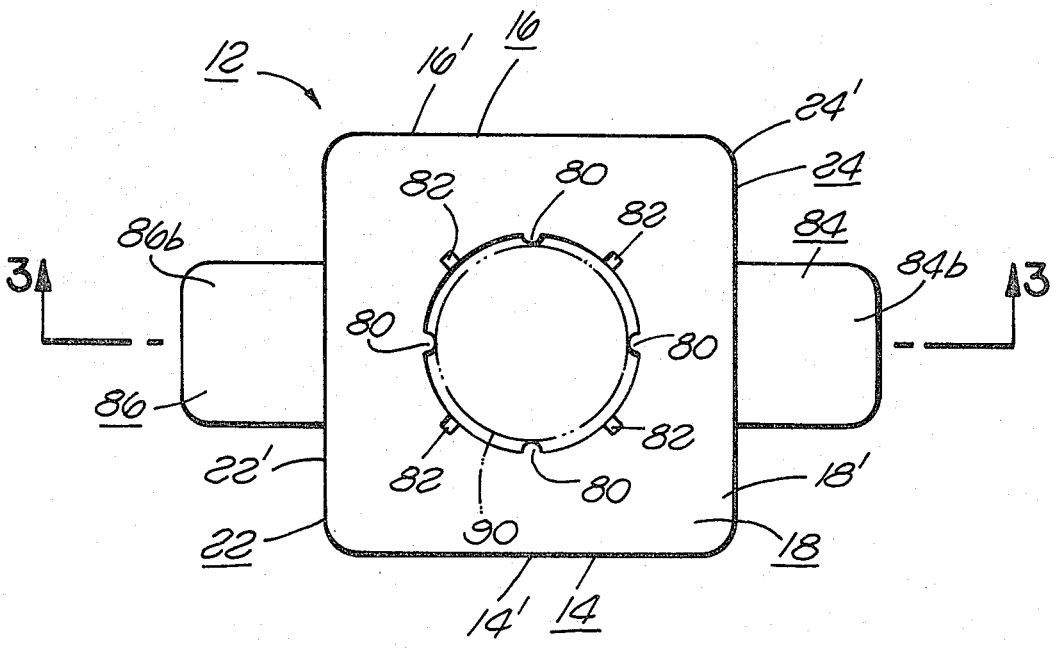
FIG. 2 is a plan view of the embodiment of the invention shown in FIG. 1.

In those embodiments of the present invention wherein the ridges 80 are provided on the internal surface 52 and 60 of first skirt means 50 and second skirt means 58, respectively, it is preferred that the male interblock coupler means on other blocks, such as first and second male interblock coupler means 84 and 86 on such other blocks are dimensioned so the external surfaces 84' and 86', respectively, thereof selectively contact the ridges 80 as indicated by phantom line 90 of FIG. 2. Such a dimensional configuration provides a more precise control of the frictional forces necessary for interconnecting one block with another block according to the principles of the present invention and the removal thereof. It will be appreciated that in those embodiments wherein the ridges 80 are not provided, the external surfaces 84' and 86' of the male interblock coupler means 84 and 86, respectively, of one block selectively contact the internal surfaces 52 and 60 of female interblock coupler means 48 of another block.

In order to aid in the coupling of first body member 28 with second body member 30, the internal surface 86*a'* of first male member 86*a* of second male coupler means 86 is provided with a first headed male member 90 having a shaft portion 92 which extends from the inner surface 86*a'* into the body cavity 26 of body means 12, and a head portion 94. Aligned with first headed male member 90 are walls 96, defining an aperture 98 in a boss 100 on the internal surface 86*b'* of second male member 86*b* of second male interblock coupling means 86 for receiving the headed portion 94 of headed male member 90. Similarly, a second headed male member 102 is coupled to the inside surface 84*b''* of second male member 84*b* of first male interblock coupling means 84, and second headed male member 102 is provided with a headed portion 104 fitting into an aperture 106 provided in boss 108 on internal wall 84*a''* of first male member 82*a* of first male interblock coupling means 84. The first headed male member 90 and second headed male member 102 are therefore substantially identical and aid in the secure coupling of first body member 28 with second body member 30 to prevent inadvertent separation thereof during normal play activity involving the interconnection of one toy block according to the principles of the present invention with another toy block according to the principles of the present invention.

Figure 6:
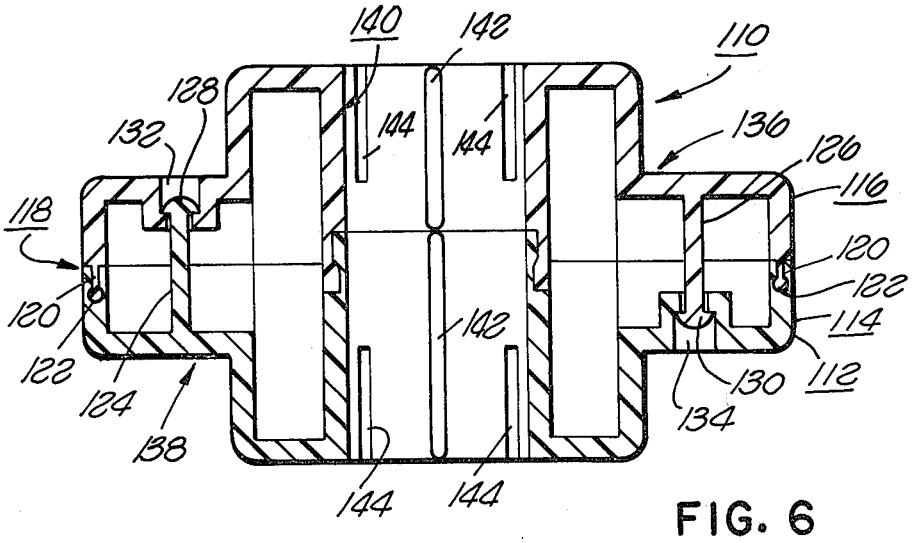
FIG. 6 illustrates another embodiment of the present invention.

FIG. 6 illustrates another embodiment generally designated 110 according to the principles of the present invention. FIG. 6 is a sectional view, generally similar to the sectional view shown in FIG. 3.

In embodiment 110 there is provided a body means 112 comprised of a first body member 114 and a second body member 116 which is coupled thereto. The first body member 114 is generally similar to the first body member 28, described above, and the second body member 116 is generally similar to the second body member 30, described above. However, in embodiment 110, a modified form of coupling means for coupling first body member 114 to second body member 116 is provided. The coupling means, generally designated 118, is comprised of a plurality of headed male members 120 extending from the second body member 116 into appropriately configured apertures 122 in first body member 114. The headed male members 120 of coupling means 118 provide for more secure coupling of the second body member 116 to the first body member 114. Additionally, the coupling means 118 may also comprise first headed male member 124 and second headed male member 126 generally similar to headed male members 90 and 102, described above, with head portions 128 and 130, respectively, fitting into apertures 132 and 134 respectively. In the embodiment 110, the apertures 132 and 134 extend entirely through the walls defining first and second male interblock coupling means 136 and 138, respectively. The body means 112 may be provided with a female interblock coupling means generally designated 140 and, if desired, may be provided with ridges 142 generally similar to the ridges 80 described above and with slots 144 generally similar to the slots 82 described above.

As can be seen from FIGS. 1 through 6, in the preferred embodiments of the present invention, the body members, skirt members and interblock coupling means are all unitarily molded and fabricated together. Thus, the body means comprises only the two separate body members, all of the remaining structure is integrally molded with the first and second body members.

Figure 7:
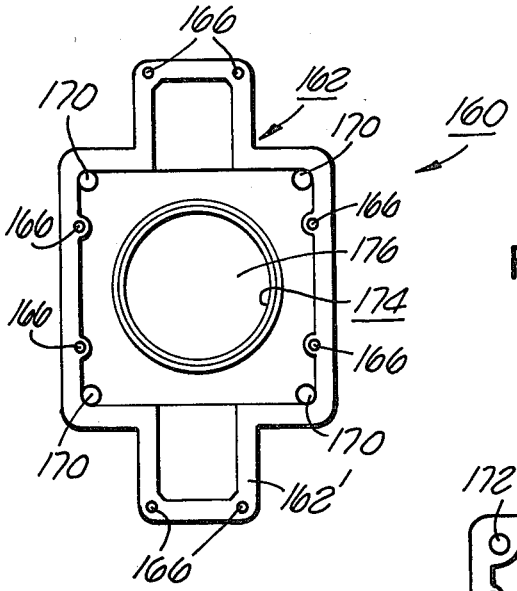
FIGS. 7 and 8 illustrate the two body members of another embodiment of the present invention.
Figure 8:
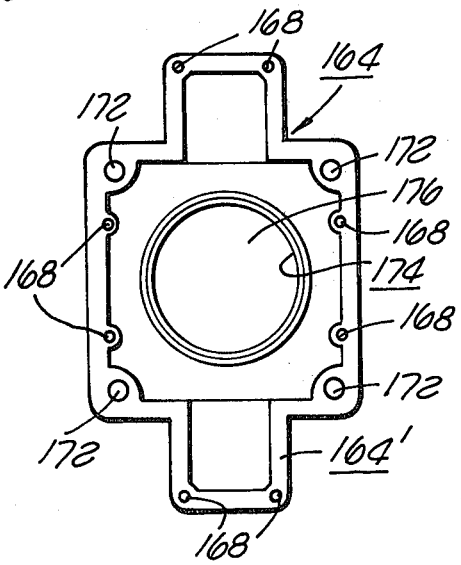

FIGS. 7 and 8 illustrate another embodiment generally designated 160 according to the principles of the present invention. FIG. 7 illustrates a body member 162 and FIG. 8 illustrates a body member 164, which, when coupled together, provides a body means in accordance with the principles of the present invention. In FIGS. 7 and 8, which are similar, respectively, to FIGS. 4 and 5 of embodiment 10, described above, there is provided an alternative arrangement for providing the coupling means between the first body member 162 and the second body member 164. The coupling means may generally comprise a plurality of male body coupling members 166, located on peripheral edges 162' of first body member 162 and extending outwardly therefrom. The plurality of male body coupling members 166 may be cylindrical in configuration, such as the male body coupling members 36 of embodiment 10 described above, or they may be headed male members such as the headed male body coupling members 120 of embodiment 110 described above. Appropriately configured apertures 168 are provided in peripheral edge 164' of second body member 164 for accepting the plurality of male coupling members 166. However, in embodiment 160, additional headed male members 170 are provided in the corners of the first body member 162 adjacent the peripheral edges 162' and are adapted to fit into appropriately configured cavities 172, located in the peripheral edge 164' of second body member 164. The male coupling members 170 are generally similar to the headed male coupling members 90, 102, 124 and 126, described above, or, alternatively, they may be cylindrical. Female interblock coupler means generally designated 174, generally similar to female interblock coupler means 48 and female interblock coupler means 140, described above, is provided. However, in the embodiment 160, there are no internal ridges or slots provided or associated with the female interblock coupler means 174. However, female interblock coupler means 174 does define a male interblock coupler means receiving aperture 176 for receiving a male interblock coupler means of another block.

In the embodiments 10, 110 and 160 described above, there has been illustrated embodiments of the present invention in which two male interblock coupler means are provided, extending outwardly from oppositely disposed walls of the body means. It will be appreciated that other arrangements and configurations of male interblock coupler means may be provided, as well as other variations in the configuration and number of female interblock coupler means.

Figure 9:
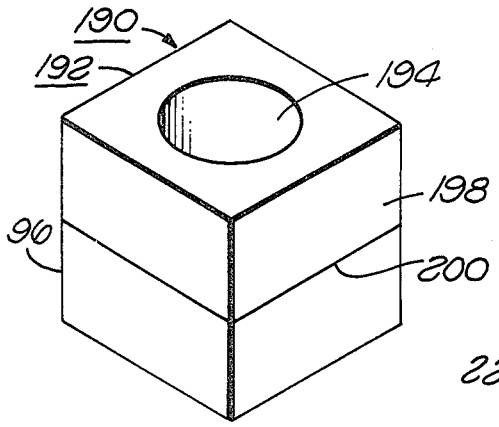
FIG. 9 is a perspective view of another embodiment of the present invention.

FIG. 9 illustrates an embodiment generally designated 190 in which a body means 192 is provided, having a female interblock coupler means 194 therein. The female interblock coupler means 194 may be generally similar to the female interblock coupler means 48 and 140 described above. However, as shown on FIG. 9, no internal ridges and no slots are provided in the female interblock coupler means 194. The body means 192 is comprised of a first body member 196 and second body member 198, coupled together as described above, along a median plane 200. In embodiment 190, however, no male interblock coupler means are provided.

Figure 10:
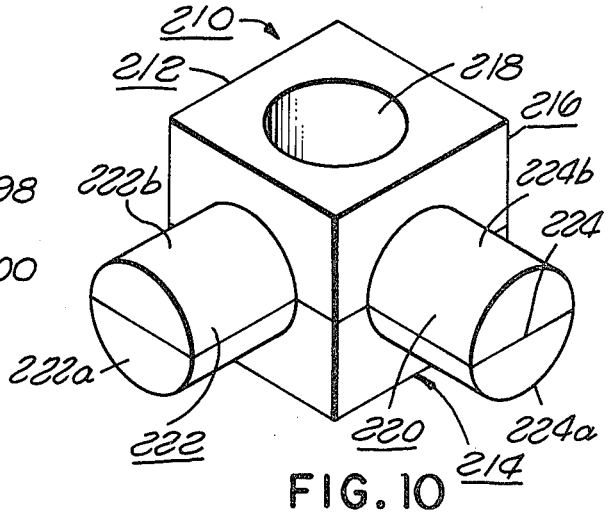
FIG. 10 is a perspective view of another embodiment of the present invention.

FIG. 10 illustrates another embodiment of the present invention, generally designated 210. In the embodiment 210, there is provided a body means 212 comprised of a first body member 214, coupled together to a second body member 216. The coupling means utilized to interconnect the first body member 214 to the second body member 216 may be any of the coupling means described above. Embodiment 210 is also provided with a female interblock coupler means 218 which, for example, may be similar to female interblock coupler means 194 of embodiment 190 or to female interblock coupler means 48 or 140, described above. In the embodiment 210, there are also provided a first male interblock coupler means generally designated 220 and a second male interblock coupler means 222, which, for example, may be generally similar to first and second male interblock coupler means 84 and 86, respectively, described above. However, in the embodiment 210, the first male interblock coupler means 220 extends outwardly in a direction substantially perpendicular to the direction of second male interblock coupler means 222. As described above in connection with embodiment 10, each of the first male interblock coupler means 220 and second male interblock coupler means 222 are divided by the median plane 224 to provide a first male member **224*a* on first body member 214 and a second male member 224*b* on second body member 216. Similarly, second male interblock coupler means 222 is divided by the median plane 224 to provide a first male member 222*a* on first body member 214 and a second male member 222*b* on second body member 216**.

Figure 11:
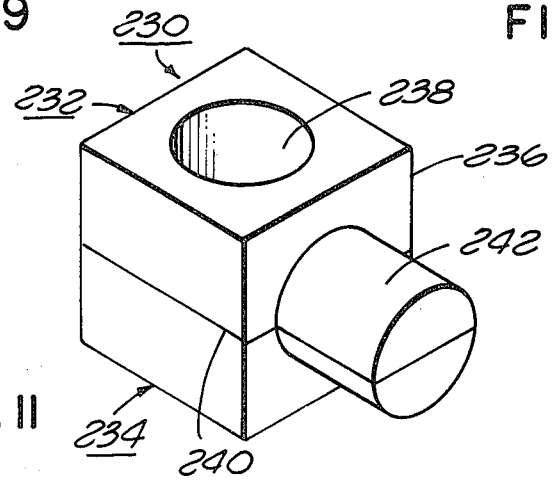
FIG. 11 is a perspective view of another embodiment of the present invention.

FIG. 11 illustrates another embodiment of the present invention, generally designated 230, in which there is provided a body means 232, comprised of a first body member 234, coupled to a second body member 236, by any of the above mentioned coupling means. A female interblock coupler means 238 is also provided, which may be similar to any of the above described female interblock coupler means. In the embodiment 230, the first body member 234 is coupled together with the second body member 236 along a median plane 240. Only one male interblock coupler means, generally designated 242 is provided in the embodiment 230, and may be generally similar to any of the male interblock coupler means described above.

Figure 12:
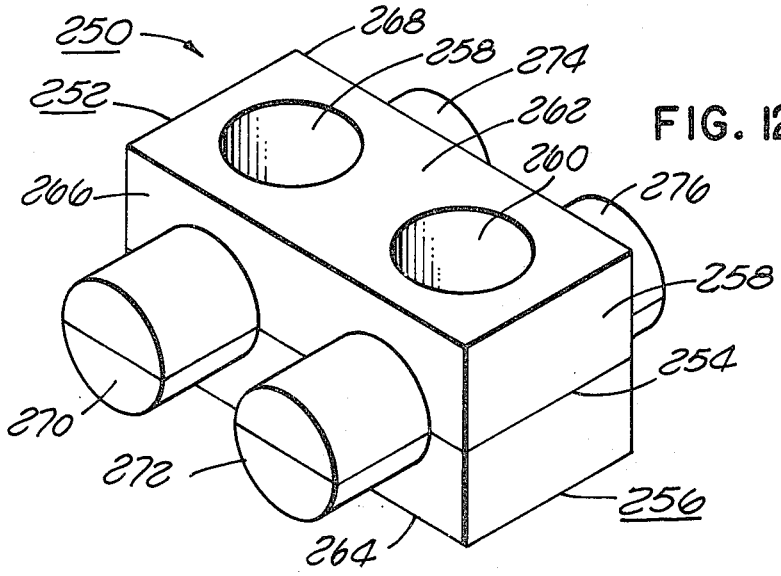
FIG. 12 is a perspective view of another embodiment of the present invention.

FIG. 12 illustrates another embodiment of the present invention, generally designated 250, comprised of a body means 252, divided by a median plane 254 into a first body member 256 and a second body member 258. The first body member 256 may be coupled to the second body member 258 by any of the above described coupling means. Body means 252 in the embodiment 250 is provided with two female interblock coupler means 258 and 260, which may be similar to any of the above described female interblock coupler means. Both of the female interblock coupler means 258 and 260, which are in spaced apart relationship, extend through body means 256 from wall member 262 to wall member 264 thereof. Wall member 266 is provided with a pair of spaced apart male interblock coupler means 270 and 272, extending outwardly from all member 266, and wall member 268 is provided with a pair of spaced apart male interblock coupler means 274 and 276. Each of the male interblock coupler means 270, 272, 274 and 276 may be generally similar to any of the male interblock coupler means described above.

Many other variations of configurations of toy blocks according to the principles of the present invention may be made. Thus, according to the principles of the present invention, each toy block arrangement is provided with at least one female interblock coupler means. The toy blocks of any one set may be provided with no male interblock coupler means, one, two, three, four, or more male interblock coupler means, and, for each such set, the male interblock coupler means are frictionally and detachably mountable in the female interblock coupler means of other blocks of the set. Further, the body means of each toy block, according to the principles of the present invention, is comprised of two separate body members, coupled together along a median plane which also divides the male interblock coupling means, if such be provided on the particular block, into two male members, one forming a part of each of the body members. All of the structure of any one block is integrally molded as part of and formed with, one or the other of the body members of the body means.

This concludes the description of the present invention. Those skilled in the art may find many variations and adaptations of the present invention, and all such variations and adaptations falling within the true scope and spirit of the present invention are intended to be covered by the appended claims.

What is claimed is:

1. A toy block arrangement comprising, in combination:

a semi-rigid body means having a first predetermined flexibility and having a plurality of wall members, and each of said plurality of wall members having inner surfaces and outer surfaces, and said inner surfaces thereof defining a body cavity, and said body means comprising:

a first body member having a first group of said plurality of wall members; and a second body member having a second group of said plurality of wall members; and said first body member coupled to said second body member along a median plane and each of said first and second body members having peripheral edge surfaces at said median plane;

coupling means on said first body member and said second body member for coupling said first body member to said second body member along said median plane;

a first wall of said first group of said plurality of wall members of said first body member of said body means having first internal walls defining a first aperture therethrough;

a second wall of said second group of said plurality of wall members of said second body member of said body means having second internal walls defining a second aperture therethrough aligned with said first aperture;

female interblock coupling means on said first wall of said first group of said plurality of wall members of said first body member and on said second wall of said second group of said plurality of wall members of said second body member of said body means, and comprising:

a first skirt member on said inner surface of said first wall of said first body member at said first aperture and extending into said body cavity, and said first skirt having an outer end coupled to said first internal walls, an inner end in said body cavity, and inner wall surfaces and outer wall surfaces extending between said outer end and said inner end;

a second skirt member on said inner surface of said second wall of said second body member at said second aperture and extending into said body cavity, and said second skirt having an outer end coupled to said second internal walls, an inner end in said body cavity, and inner wall surfaces and outer wall surfaces extending between said outer end and said inner end thereof;

and for the condition of said first body member coupled to said second body member said inner wall surfaces of said first skirt member and second skirt member defining a male interblock coupler means receiving aperture extending from said first wall of said first body member through said body cavity to said second wall of said second body member in an aligned relationship, and said male interblock coupler means receiving aperture separated from said body cavity by said first skirt member and said second skirt member, and said first skirt member and said second skirt member being in aligned relationship;

said inner end of said first skirt member and said inner end of said second skirt member extending beyond said median plane, and said coupling means further comprising:

interlock means on said interior ends of said first and said second skirt members for interlocking said first skirt member to said second skirt member.

2. The arrangement defined in claim 1, wherein:

said interlock means further comprises:

a first peripheral shoulder and a first peripheral groove on said inner wall surfaces of said first skirt member;

a second peripheral shoulder and a second peripheral groove on said outer wall surfaces of said second skirt member, and said first peripheral shoulder positionable in said second peripheral groove and said second peripheral shoulder positionable in said first peripheral groove for interlocking retention therebetween.

3. The arrangement defined in claim 2, and further comprising:

a plurality of internal ridges on said inner wall surfaces of said first skirt member, and said plurality of ridges extending from regions adjacent said outer end toward said interior end thereof.

4. The arrangement defined in claim 3, and further comprising:

said second skirt member having a plurality of internal ridges on said inner wall surface thereof extending from regions adjacent said outer end toward the interior end thereof.

5. The arrangement defined in claim 2, and further comprising:

first slot walls on said first skirt member defining first slots therethrough, and said first slots extending from said outer end toward said interior end thereof.

6. The arrangement defined in claim 5 and further comprising:

second slot walls on said second skirt member defining second slots therethrough, and said second slots extending from said outer end toward said interior end thereof.

7. The arrangement defined in claim 6, wherein:

said first slots on said first skirt member and said second slots on said second skirt member extend a distance substantially one-half the distance from said outer ends to said interior ends thereof.

8. The arrangement defined in claim 1 and further comprising:

said inner wall surfaces and said outer wall surfaces of said first skirt member and said second skirt member are in an aligned relationship for the condition of said first body member coupled to said second body member.

9. The arrangement defined in claim 6 and further comprising:

said first slot walls extend through said first wall of said first group of said plurality of wall members of said first body member of said body means; and said second slot walls extend through said second wall of said second group of said plurality of wall members of said second body member.

10. The arrangement defined in claim 4, wherein:

said coupling means for coupling said first body member to said second body member further comprises:

a plurality of male body coupling members extending outwardly from said peripheral edge surface of said first body member;

walls on said peripheral edge surface of said second body member defining a plurality of male body coupling member receiving cavities therein; and said plurality of male body coupling members positionable in said male body coupling member receiving cavities and frictionally retainable therein to couple said first body member to said second body member.

11. The arrangement defined in claim 10, wherein:

said male body coupling members further comprise:

a shaft portion; and a headed portion coupled to said shaft portion and spaced from said peripheral edge surface, and said headed portion having a greater dimension than said shaft portion.

12. The arrangement defined in claim 2, and further comprising:

a third wall member of said plurality of wall members of said body means further comprises a first male interblock coupler means frictionally and detachably retainable in a female coupler means of another toy block.

13. The arrangement defined in claim 12, wherein:

said first male interblock coupler means is divided by said median plane and comprises a first male member on said first body member of said body means and a second male member on said second body member of said body means;

said coupling means further comprises:

a plurality of male body coupling members extending outwardly from said peripheral edge surface of said first body member;

walls on said peripheral edge surface of said second body member defining a plurality of male body coupling member receiving cavities therein; and said plurality of male body coupling members positionable in said male body coupling member receiving cavities and frictionally retainable therein to couple said first body member to said second body member;

a first headed male member coupled to said first male member of said first male interblock coupler means and extending into said body cavity; and walls defining an aperture in said second male member of said male interblock coupler means communicating with said body cavity for retaining said first headed male member therein.

14. The arrangement defined in claim 12, and further comprising:

a fourth wall member of said plurality of wall members of said body means further comprises a second male interblock coupler means frictionally and detachably retainable in a female interblock coupler means of another toy block.

15. The arrangement defined in claim 14, wherein:

each of said first and second male interblock coupler means is divided by said median plane and comprises a first male member on said first body member of said body means and a second male member on said second body member of said body means;

a first headed male member on said first male member of said first male interblock coupler means extending into said body cavity;

walls on said second male member of said first male interblock coupler means defining a headed male member receiving aperture communicating with said body cavity for retaining said first headed male member therein;

a second headed male member on said second male member of said second male interblock coupler means and extending into said body cavity;

walls in said first male member of said second male interblock coupler means defining a second headed male member receiving aperture communicating with said body cavity for retaining said second headed male member therein.

16. The arrangement defined in claim 15, wherein:

said second male interblock coupler means is aligned with said first male interblock coupler means.

17. The arrangement defined in claim 15, wherein:

said second male interblock coupler means extends substantially at right angles to said first male interblock coupler means.

18. The arrangement defined in claim 14, and further comprising:

said third wall member of said plurality of wall members of said body means further comprises a third male interblock coupler means frictionally and detachably retainable in a female interblock coupler means of another toy block.

19. The arrangement defined in claim 14, wherein:

said third wall member of said plurality of wall members of said body means further comprises a third male interblock coupler means frictionally and detachably retainable in the female interblock coupler means of another toy block and said fourth wall member of said plurality of wall members of said body means further comprises a fourth male interblock coupler means aligned with said third male interblock coupler means and said fourth male interblock coupler means frictionally and detachably retainable in the female interblock coupler means of another toy block.

* * * * *